US007714816B2

(12) United States Patent
Umezaki

(10) Patent No.: US 7,714,816 B2
(45) Date of Patent: May 11, 2010

(54) DISPLAY DEVICE, DISPLAY MODULE, ELECTRONIC APPARATUS AND DRIVING METHOD OF THE DISPLAY DEVICE

(75) Inventor: Atsushi Umezaki, Kanagawa (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 737 days.

(21) Appl. No.: 11/277,883

(22) Filed: Mar. 29, 2006

(65) Prior Publication Data

US 2006/0221006 A1 Oct. 5, 2006

(51) Int. Cl.
*G09G 3/32* (2006.01)

(52) U.S. Cl. ..... 345/82; 345/204

(58) Field of Classification Search ..... 345/36, 345/45, 76, 82, 204
See application file for complete search history.

(56) References Cited

U.S. PATENT DOCUMENTS

| | | | | |
|---|---|---|---|---|
| 5,592,164 | A * | 1/1997 | Hilbert et al. | 341/120 |
| 6,054,976 | A | 4/2000 | Kubota et al. | |
| 6,219,113 | B1 | 4/2001 | Takahara | |
| 6,335,713 | B1 | 1/2002 | Imai | |
| 6,349,906 | B1 | 2/2002 | Anderson | |
| 6,501,466 | B1 | 12/2002 | Yamagishi et al. | |
| 6,774,574 | B1 | 8/2004 | Koyama | |
| 6,777,887 | B2 | 8/2004 | Koyama | |
| 2002/0153844 | A1 | 10/2002 | Koyama | |
| 2002/0180721 | A1 | 12/2002 | Kimura et al. | |
| 2003/0062545 | A1 * | 4/2003 | Yamazaki et al. | 257/200 |
| 2003/0063081 | A1 | 4/2003 | Kimura et al. | |
| 2003/0128201 | A1 | 7/2003 | Ishizuka | |
| 2003/0179163 | A1 | 9/2003 | Tsuchida | |
| 2004/0100463 | A1 * | 5/2004 | Miyagawa et al. | 345/212 |

(Continued)

FOREIGN PATENT DOCUMENTS

| | | |
|---|---|---|
| EP | 1 063 630 | 12/2000 |

(Continued)

OTHER PUBLICATIONS

European Search Report (Application No. 06006436.7), dated Sep. 7, 2006, 3 pages.

(Continued)

*Primary Examiner*—Chanh Nguyen
*Assistant Examiner*—Kwang-Su Yang
(74) *Attorney, Agent, or Firm*—Fish & Richardson P.C.

(57) ABSTRACT

To provide a display device which can apply a voltage at which an operating point becomes a saturation region even when a light-emitting element deteriorates without applying a voltage to a driving TFT and the light-emitting element larger than necessary. A monitor pixel has a monitor pixel power supply line, a first light-emitting element, and a first TFT, while a pixel in the display region has a power supply line, a second TFT as a driving TFT, a signal line which gives a signal to a gate of the second TFT, a third TFT, and a second light-emitting element. A potential of the monitor pixel power supply line and a gate potential of the first TFT of the monitor pixel are sampled to be set as a potential of the power supply line of the pixel and a potential of the signal line of the pixel, respectively.

34 Claims, 9 Drawing Sheets

U.S. PATENT DOCUMENTS

| | | | | |
|---|---|---|---|---|
| 2004/0207331 | A1 | 10/2004 | Koyama | |
| 2004/0263445 | A1* | 12/2004 | Inukai et al. | 345/82 |
| 2005/0012731 | A1 | 1/2005 | Yamazaki et al. | |
| 2005/0017963 | A1 | 1/2005 | Yamazaki et al. | |
| 2005/0017964 | A1 | 1/2005 | Yamazaki et al. | |
| 2005/0062691 | A1* | 3/2005 | Tamura et al. | 345/76 |
| 2005/0285823 | A1 | 12/2005 | Kimura et al. | |
| 2006/0108529 | A1* | 5/2006 | Saito et al. | 250/338.4 |

FOREIGN PATENT DOCUMENTS

| | | | |
|---|---|---|---|
| EP | 1 102 234 | | 5/2001 |
| EP | 1 282 101 | | 2/2003 |
| EP | 1 318 499 | | 6/2003 |
| EP | 1 469 449 | | 10/2004 |
| EP | 1 598 804 | | 11/2005 |
| JP | 2001-005426 | | 1/2001 |
| JP | 2001-109433 | | 4/2001 |
| WO | WO 01/27910 | A1 | 4/2001 |
| WO | WO2004/040542 | | 5/2004 |
| WO | WO2005-027085 | | 3/2005 |

OTHER PUBLICATIONS

Dawson et al.; "Design of an Improved Pixel for a Polysilicon Active-Matrix Organic LED Display"; *SID 98 Digest*; pp. 11-14; May 17-22, 1998.

Mizukami et al.; "6-Bit Digital VGA OLED"; *SID 00 Digest*; vol. XXXI, pp. 912-915, May 16-18, 2000.

Office Action (Application No. 200610071984.8: CN8626), dated Jan. 16, 2009, 23 pages.

Office Action dated Aug. 24, 2009 from EP Application No. 06 006 436.7, 6 pages.

* cited by examiner

DISPLAY DEVICE, DISPLAY MODULE, ELECTRONIC APPARATUS AND DRIVING METHOD OF THE DISPLAY DEVICE

BACKGROUND OF THE INVENTION

1. Field of the Invention

The present invention relates to an active matrix display device and a driving method thereof. The invention particularly relates to a display device having a switching element such as a thin film transistor (hereinafter referred to as a TFT) and a light-emitting element in each pixel, and a driving method thereof. In addition, the invention relates to an electronic apparatus using the display device and a driving method thereof.

2. Description of the Related Art

In recent years, technology to form a TFT has greatly progressed, and application development for an active matrix display device has been promoted. Particularly, since the field effect mobility (also called mobility) of a TFT using a polysilicon film as an active layer is higher than that of a TFT using a conventional amorphous silicon film, high speed operation is possible. Therefore, by using a driver circuit formed by using TFTs over the same substrate as pixels, control of the pixels can be performed. In a display device in which various circuits include TFTs over the same substrate as the pixels, various advantages such as reduction of manufacturing cost, downsizing, increase of yield, reduction of throughput are obtained.

Research has been activated on an active matrix EL display device having an electroluminescence element (hereinafter referred to as an EL element) which is a light-emitting element as a display element included in each pixel of a display device. An EL display device is also called an organic EL display (OELD: Organic EL Display) or an organic light-emitting diode (OLED: Organic Light-Emitting Diode).

In general, since light emission luminance of an EL element has a proportional relation with a current value flowing to the EL element, an EL display device using the EL element as a display element controls light emission luminance with the current value. As a method of a gray scale expression, in a configuration in which the EL element and the TFT (referred to as a driving TFT) are connected in series between two power supply lines, there is a method in which the driving TFT is operated in a saturation region, and a voltage between a gate and source of the driving TFT is changed to control the current value flowing to the EL element. In addition, there is a driving method in which the current value flowing to the EL element is constant, and light emission luminance is controlled by the time when a current flows to the EL element in a predetermined time to express a gray scale (see the following Patent Document 1).

[Patent Document 1] Japanese Patent Laid-Open No. 2001-5426

SUMMARY OF THE INVENTION

In a configuration in which an EL element (a light-emitting element) and a driving TFT (a driving transistor) are connected in series between two power supply lines that are held to have a predetermined potential difference, when the light-emitting element deteriorates, an operating point between the driving transistor and the light-emitting element has a possibility to become a linear region of the driving transistor. Therefore, it has been necessary to lower a potential of an electrode (hereinafter also called a counter electrode) not connected to the driving transistor between two electrodes of the light-emitting element so as not to operate the driving transistor in the linear region. Thus, a potential difference between a source of the driving transistor and the counter electrode had to be increased.

Description is made on the reason why the aforementioned potential difference between the source of the driving transistor and the counter electrode is required to be increased with reference to FIGS. 1 and 2.

FIG. 1 shows a pixel configuration of a basic organic EL display. In FIG. 1, reference numerals 101 and 102 denote TFTs, 103 denotes a capacitor, 104 denotes a light-emitting element, 105 denotes a counter electrode of the light-emitting element 104, 106 denotes a power supply line, 107 denotes a source signal line, 108 denotes a gate signal line, and 109 denotes a node Vm. The TFT 101 corresponds to the aforementioned driving transistor, and the TFT 101 and the light-emitting element 104 are connected in series between the power supply line 106 and the counter electrode 105.

FIG. 2 shows a diagram showing a relation of operating points between the TFT 101 and the light-emitting element 104 of the pixel configuration of FIG. 1. In FIG. 2, reference numeral 201 shows a property of the TFT 101, 202 shows a property of the light-emitting element 104, 203 and 204 show properties of the light-emitting element 104 after having deteriorated, 205 shows an operating point between the 201 and the 202, 206 shows an operating point between the 201 and the 203, 207 shows an operating point between the 201 and the 204, 208 shows a pinch-off point, 209 shows a pinch-off curve, 210 shows a potential of the counter electrode 105, 211 shows a potential of the power supply line 106, 212 shows a current flowing between a source and drain of the TFT 101, 213 shows a current flowing to the light-emitting element 104, 214 shows a voltage between the source and drain of the TFT 101, and 215 shows a voltage between a pair of electrodes of the light-emitting element 104.

FIG. 2 shows changes of the operating point between the TFT 101 and the light-emitting element 104 when the light-emitting element 104 deteriorates under the condition that the voltage between the gate and source of the TFT 101 is set to be an arbitrary constant voltage. When the light-emitting element 104 deteriorates, the property of the light-emitting element 104 changes from the property 202 into the property 203 and the property 204. In addition, the operating point is also changed from the operating point 205 into the operating point 206 and the operating point 207. When the operating point changes from the saturation region to the linear region due to the deterioration of the light-emitting element 104, the current value flowing to the light-emitting element 104 decreases sharply, thereby luminance of the light-emitting element 104 decreases sharply. Therefore, in order to prevent the operating point from being in the linear region due to the deterioration of the light-emitting element 104, the potential difference between the counter electrode 105 and the power supply line 106 is required to be increased in advance.

As a method to increase the potential difference between the counter electrode 105 and the power supply line 106, in the case of using a P-channel TFT as the driving transistor (TFT 101) as shown in FIG. 1, there is a method to lower the potential of the counter electrode 105. This is because when the potential of the power supply line 106 increases, the potential difference between the gate and source of the driving TFT is changed so that the luminance control becomes difficult to perform.

In this manner, although the current value flowing to the light-emitting element and the luminance are hardly changed when the potential difference between the counter electrode 105 and the power supply line 106 is increased, only a voltage applied is increased; therefore, there is a problem that power consumption is increased.

In the invention, the aforementioned defect is solved and the operating point between the light-emitting element and the driving transistor is set to be close to the pinch-off point in accordance with the deterioration of the light-emitting element, so that the potential of the counter electrode 105 is not changed more than required and the low power consumption of the display device is realized.

A display device of the invention includes: a current source; a first wiring; a second wiring; a first light-emitting element; and a first transistor, one of a source and drain of the first transistor is electrically connected to the current source through the first wiring, and the other of the source and drain of the first transistor and a gate of the first transistor are electrically connected to the second wiring and one electrode of the first light-emitting element.

A display device of the invention includes: a current source; a first wiring; a second wiring; a first light-emitting element; and a first transistor, one of a source and drain of the first transistor and a gate of the first transistor are electrically connected to the current source through the first wiring, and the other of the source and drain of the first transistor is electrically connected to one electrode of the first light-emitting element and the second wiring.

A display device of the invention includes: a current source; a first wiring electrically connected to a first sampling circuit; a second wiring electrically connected to a second sampling circuit; a first light-emitting element; and a first transistor, one of a source and drain of the first transistor is electrically connected to the current source through the first wiring, and the other of the source and drain of the first transistor and a gate of the first transistor are electrically connected to the second wiring and one electrode of the first light-emitting element.

A display device of the invention includes: a current source; a first wiring electrically connected to a digital-analog converter circuit; a second wiring electrically connected to the digital-analog converter circuit; a first light-emitting element; and a first transistor, one of a source and drain of the first transistor is electrically connected to the current source through the first wiring, and the other of the source and drain of the first transistor and a gate of the first transistor are electrically connected to the second wiring and one electrode of the first light-emitting element.

A display device of the invention includes: a current source; a first wiring; a second wiring; a third wiring; a first light-emitting element; a second light-emitting element; a first transistor; a second transistor; a first sampling circuit holding a potential of the first wiring for a certain period and supplying the potential to the third wiring; a second sampling circuit holding a potential of the second wiring for a certain period; a digital-analog converter circuit in which a minimum output potential and a maximum output potential are determined by the potential held in the first sampling circuit and the potential held in the second sampling circuit; and a circuit supplying a signal in accordance with an output of the digital-analog converter circuit to a gate of the second transistor, one of a source and drain of the first transistor is electrically connected to the current source through the first wiring, the other of the source and drain of the first transistor and a gate of the first transistor are electrically connected to the second wiring and one electrode of the first light-emitting element, one of a source and drain of the second transistor is electrically connected to the third wiring, and the other of the source and drain of the second transistor is electrically connected to one electrode of the second light-emitting element.

A display device of the invention includes: a current source; a first wiring; a second wiring; a third wiring; a fourth wiring; a fifth wiring; a first light-emitting element; a second light-emitting element; a first transistor; a second transistor; a third transistor; a first sampling circuit holding a potential of the first wiring for a certain period and supplying the potential to the third wiring; a second sampling circuit holding a potential of the second wiring for a certain period; a digital-analog converter circuit in which a minimum output potential and a maximum output potential are determined by the potential held in the first sampling circuit and the potential held in the second sampling circuit; a source driver supplying a signal in accordance with an output of the digital-analog converter circuit to the fourth wiring; and a gate driver supplying a selection signal to the fifth wiring, one of a source and drain of the first transistor is electrically connected to the current source through the first wiring, the other of the source and drain of the first transistor and a gate of the first transistor are electrically connected to the second wiring and one electrode of the first light-emitting element, one of a source and drain of the second transistor is electrically connected to the third wiring, the other of the source and drain of the second transistor is electrically connected to one electrode of the second light-emitting element, one of a source and drain of the third transistor is electrically connected to the fourth wiring, the other of the source and drain of the third transistor is electrically connected to a gate of the second transistor, and a gate of the third transistor is electrically connected to the fifth wiring.

In the display device of the invention, the potential of the signal in accordance with the output of the digital-analog converter circuit is smaller than the potential of the first wiring.

In the display device of the invention, the first transistor and the second transistor are P-channel transistors.

In the display device of the invention, a channel width and a channel length of the first transistor are the same as a channel width and a channel length of the second transistor.

In the display device of the invention, the first transistor and the second transistor are formed over the same substrate as the second light-emitting element.

In the display device of the invention, an operating point of the first transistor and the first light-emitting element and an operating point of the second transistor and the second light-emitting element are a saturation region of the first transistor and a saturation region of the second transistor respectively.

In the display device of the invention, a structure of first light-emitting element is the same as a structure of the second light-emitting element.

In the display device of the invention, the first transistor is a normally off transistor.

More particularly, the display device of the invention has a plurality of monitor pixels, a monitor pixel power supply line, a plurality of pixels, a power supply line, and a signal line for determining a gate potential of the second transistor. Each of the plurality of monitor pixels has a first transistor and a first light-emitting element having a pair of electrodes. Each of the plurality of pixels has a second transistor and a second light-emitting element having a pair of electrodes. The monitor pixel power supply line is connected to one of a source and drain of the first transistor, the other of the source and drain of the first transistor is connected to one electrode of the first light-emitting element and a gate electrode of the first transistor. In addition, the power supply line is connected to one of a source and drain of the second transistor, the other of the source and drain of the second transistor is connected to one electrode of the second light-emitting element, and a potential from the signal line is given to a gate electrode of the second transistor. Here, each of a potential of the monitor pixel power supply line and a gate potential of the first transistor of the monitor pixel is sampled when a constant current is flowed into the first transistor and the first light-emitting element. The sampled gate potential of the first transistor is set to be a potential of the signal line included in the pixel and the sampled potential of the monitor pixel power supply line is set to be a potential of the power supply line included in the pixel; therefore, in accordance with the deterioration of the light-emitting element, an operating point between the second transistor and the second light-emitting element can always be set in a saturation region close to a pinch-off point of the second transistor so that the potential difference between the power supply line and the counter electrode can be prevented from being at excessive levels.

The potential sampled in the monitor pixel is described. A connecting point between the other of the source and drain of the first transistor and one electrode of the first light-emitting element of the monitor pixel is connected to the gate electrode of the first transistor. Therefore, the potential of the monitor pixel power supply line and the gate potential of the first transistor can be sampled when an operating point of the first transistor becomes close to the pinch-off point (Vds=Vgs−Vth). Vds shows a potential difference between the monitor pixel power supply line and one electrode of the first light-emitting element, Vgs shows a potential difference between the monitor pixel power supply line and the gate of the first transistor, and Vth shows a threshold voltage of the first transistor. Here, one electrode of the first light-emitting element and the gate electrode of the first transistor are connected to each other; thereby they have the same potential. That is, Vds and Vgs are the same potential. Therefore, the potential of the monitor pixel power supply line and the gate potential of the first transistor are sampled and fed back to the plurality of pixels in the display pixel region; thereby the second transistor can always be operated close to the pinch-off point when the second light-emitting element emits light at maximum luminance. That is, the gate potential of the first transistor is fed back to the signal line as a potential of the plurality of pixels in the display pixel region at maximum luminance. The potential of the monitor pixel power supply line is fed back to the signal line of the pixel and the power supply line of the pixel as a potential of the plurality of pixels in the display pixel region in non-light emission state. In this manner, the second transistor is always operated close to the pinch-off point when the second light-emitting element emits light at maximum luminance.

When a potential of the gate electrode of the first transistor is fed back to the signal line as the potential of the plurality of pixels at maximum luminance, in view of variation of the first transistor and the second transistor, a potential given to the signal line and the power supply line may be changed from the sampled potential so that an operating point of the second transistor becomes the saturation region side.

A configuration of a display device for performing display in the aforementioned driving method is described below.

(Structure 1)

The invention is a display device having a plurality of monitor pixels, a plurality of pixels, a first wiring, a second wiring, a third wiring, a fourth wiring, a fifth wiring, a sixth wiring, a constant current source, a first sampling circuit, a second sampling circuit, a digital-analog converter circuit, a source driver, and a gate driver. Each of the plurality of monitor pixels has a first P-channel transistor and a first light-emitting element having a pair of electrodes, each of the plurality of pixels has a second P-channel transistor, a third transistor, a capacitor having a pair of electrodes, and a second light-emitting element having a pair of electrodes. The constant current source is connected to the first wiring. The first wiring is connected to one of a source and drain of the first transistor. The other of the source and drain of the first transistor is connected to one electrode of the first light-emitting element, the second wiring, and a gate of the first transistor. The first wiring is connected to an input of the first sampling circuit. The second wiring is connected to an input of the second sampling circuit. An output of the first sampling circuit is connected to a power source of the digital-analog converter circuit and the fourth wiring. An output of the second sampling circuit is connected to the power source of the digital-analog converter circuit. The third wiring is connected to an input of the digital-analog converter circuit and a digital video signal is inputted thereto. An output of the digital-analog converter circuit is inputted to the source driver as a video signal. The fourth wiring is connected to one of a source and drain of the second transistor. The other of the source and drain of the second transistor is connected to one electrode of the second light-emitting element. A gate of the second transistor is connected to one electrode of the capacitor and one of a source and drain of the third transistor. The other of the source and drain of the third transistor is connected to the fifth wiring. The other electrode of the capacitor is connected to the fourth wiring. A gate of the third transistor is connected to the sixth wiring. The fifth wiring is connected to an output of the source driver while the sixth wiring is connected to an output of the gate driver. Potentials obtained by the first wiring and the second wiring are sampled with the first sampling circuit and the second sampling circuit. Each output of the first sampling circuit and the second sampling circuit is used as the power source of the digital-analog converter circuit, and a potential obtained thereby is outputted as a video signal from the fifth wiring through the source driver.

In addition, although a pixel configuration having two transistors and one capacitor in one pixel is shown, the invention is not limited to this. Any pixel configuration may be used as long as a driving method in which a voltage is outputted from the source driver and a potential of the power supply line is given to a source of the second transistor (driving transistor). For example, the pixel may have a configuration for correcting a threshold voltage of the driving transistor.

In addition, although P-channel transistors are used for the first transistor and the second transistor, an N-channel transistor may be used. In the case where an N-channel transistor is used for the first transistor, the gate of the first transistor is not required to be connected to one electrode of the first light-emitting element but connected to the first wiring.

Moreover, a terminal connected to the fourth wiring of the capacitor may be connected anywhere as long as the terminal is held at a constant potential during the operation of the second transistor. For example, the terminal may be connected to the other electrode of the second light-emitting element or may be connected to other wirings.

(Structure 2)

The invention is a display device having a plurality of monitor pixels, a plurality of pixels, a first wiring, a second wiring, a third wiring, a fourth wiring, a fifth wiring, a sixth wiring, a constant current source, a first sampling circuit, a second sampling circuit, a source driver, and a gate driver. Each of the plurality of monitor pixels has a first P-channel transistor and a first light-emitting element having a pair of electrodes. Each of the plurality of pixels has a second P-channel transistor, a third transistor, a capacitor having a pair of electrodes, and a second light-emitting element having a pair of electrodes. The constant current source is connected to the first wiring. The first wiring is connected to one of a source and drain of the first transistor. The other of the source and drain of the first transistor is connected to one electrode of the first light-emitting element, the second wiring, and a gate of the first transistor. The first wiring is connected to an input of the first sampling circuit. The second wiring is connected to an input of the second sampling circuit. An output of the first sampling circuit is connected to a power source of a buffer portion of the source driver, a power source of a level shifter portion of the source driver, and the fourth wiring. An output of the second sampling circuit is connected to the power source of the buffer portion of the source driver and the power source of the level shifter portion of the source driver. The buffer portion and the level shifter portion correspond to a buffer portion and a level shifter portion in the source driver just before an output to each signal line respectively. The third wiring inputs a video signal to the source driver. The fourth wiring is connected to one of a source and drain of the second transistor. The other of the source and drain of the second transistor is connected to one electrode of the second light-emitting element. A gate of the second transistor is connected to one electrode of the capacitor and one of a source and drain of the third transistor. The other of the source and drain of the third transistor is connected to the fifth wiring. The other electrode of the capacitor is connected to the fourth wiring. A gate of the third transistor is connected to the sixth wiring. The fifth wiring is connected to an output of the source driver while the sixth wiring is connected to an output of the gate driver. Potentials obtained by the first wiring and the second wiring are sampled with the first sampling circuit and the second sampling circuit. Each output of the first sampling circuit and the second sampling circuit is used for the power sources of the buffer portion of the source driver and the level shifter portion of the source driver, and a potential obtained thereby is to be outputted as a video signal from the fifth wiring.

In addition, although a pixel configuration having two transistors and one capacitor in one pixel is shown, the invention is not limited to this. Any pixel configuration may be used as long as a driving method that a voltage is outputted from the source driver and a potential of the power supply line is given to a source of the second transistor (driving transistor) can be employed. For example, the pixel may have a configuration for correcting a threshold voltage of the driving transistor. A means for controlling the light-emitting element to emit no light in accordance with a signal which is different from the video signal may be provided. For example, such a configuration may be used that a transistor is provided in parallel with the capacitor, charge held in the capacitor is discharged by turning ON the transistor, the driving transistor is turned OFF, and the light-emitting element is turned to emit no light.

In addition, although P-channel transistors are used for the first transistor and the second transistor, an N-channel transistor may be used. In the case where an N-channel transistor is used for the first transistor, a gate of the transistor is not required to be connected to one electrode of the first light-emitting element but may be connected to the first wiring.

Moreover, the electrode of the capacitor connected to the fourth wiring may be connected anywhere as long as the electrode is held at a constant potential during the operation of the second transistor. For example, the electrode may be connected to the other electrode of the second light-emitting element or may be connected to other wirings.

Note that a state in which a voltage greater than the threshold voltage is applied between the gate and source of the transistor and a current flows between the source and drain of the transistor is called that the transistor is turned ON. In addition, a state in which a voltage less than or equal to the threshold voltage is applied between the gate and source of the transistor and a current does not flow between the source and drain of the transistor is called that the transistor is turned OFF.

In the invention, to be connected is a synonym to be electrically connected. Therefore, in the structure of the invention, in addition to a predetermined connection relation, other elements (for example, an element such as a switch, a transistor, a diode, or a capacitor) which enable an electrical connection therebetween may be arranged.

Although Structure 1 and Structure 2 show examples in which transistors are used as an example of a switching element, the invention is not limited to them. Either an electrical switch or a mechanical switch may be used for the switching element as long as it can control a current. As the switching element, a diode may be used or a logic circuit in which a diode and a transistor are combined may be used.

In addition, in the invention, the kinds of transistors applicable as a switching element are not limited, and a TFT using a non-single crystal semiconductor film typified by amorphous silicon and polycrystalline silicon, a MOS transistor formed by using a semiconductor substrate or an SOI substrate, a junction transistor, a bipolar transistor, a transistor using an organic semiconductor or a carbon nanotube, or other transistors can be applied. In addition, the kinds of substrates over which a transistor is formed are not limited, and a single crystalline substrate, an SOI substrate, a quartz substrate, a glass substrate, a resin substrate, or the like can be freely used.

Moreover, in the case where a source potential of a transistor is close to a power source on a low potential side, the transistor is desired to be an N-channel transistor. On the other hand, in the case where the source potential of the transistor is close to a power source on a high potential side, the transistor is desired to be a P-channel transistor. Such a structure can be used to increase the absolute value of a voltage between the gate and source of the transistor; therefore, the transistor is easy to be operated as a switch. Note that a CMOS switching element using both an N-channel transistor and a P-channel transistor may be used.

The invention can be applied to a display device using as a light-emitting element, an element of which a current flowing to a pair of electrodes and luminance are in a proportional relation with each other. For example, the invention can be applied to a display device using an EL element or a light-emitting diode as a light-emitting element.

The potential of the monitor pixel power supply line and the gate potential of the first transistor of the monitor pixel are sampled to be set as a potential of the power supply line of the pixel and a potential of the signal line of the pixel, respectively, and in accordance with the deterioration of the light-emitting element, the operating point between the second transistor and the second light-emitting element can always be set in the saturation region close to the pinch-off point of the second transistor. Therefore, the potential difference between the power supply line and the counter electrode can be prevented from being at excessive levels. In this manner, a display device with small power consumption and a long operating life can be provided.

In addition, since a voltage is used as a video signal, the invention can simplify a configuration of the driver circuit which inputs a video signal into the pixel.

In addition, the invention is effective not only for a case where the light-emitting element deteriorates, but also a case where a voltage-current property of the light-emitting element is changed.

DETAILED DESCRIPTION OF THE INVENTION

Although the present invention will be fully described by way of embodiment modes and embodiments with reference to the accompanying drawings, it is to be understood that various changes and modifications will be apparent to those skilled in the art. Therefore, unless otherwise such changes and modifications depart from the scope of the present invention, they should be construed as being included therein.

Embodiment Mode 1

A display device of Structure 1 is described with reference to FIG. 4.

Figure 4:
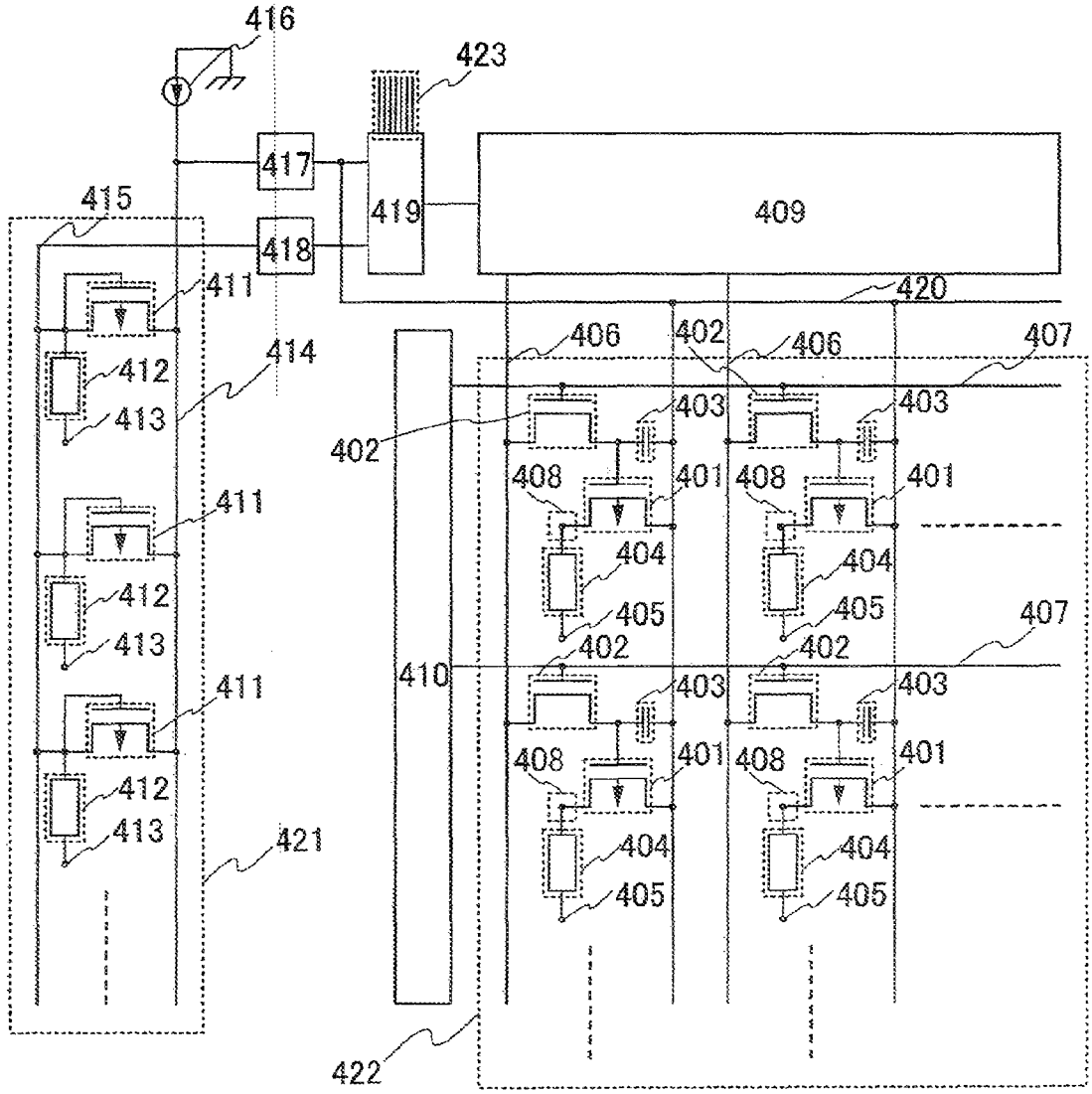
FIG. 4 is a circuit diagram showing a pixel configuration of the invention.

In FIG. 4, reference numerals 401, 402 and 411 denote TFTs, 403 denotes a capacitor, 404 and 412 denote light-emitting elements, 405 and 413 denote counter electrodes, 406 denotes a source signal line, 407 denotes a gate signal line, 409 denotes a source driver, 410 denotes a gate driver, 414 and 420 denote power supply lines, 415 denotes a sampling line, 416 denotes a constant current source, 417 and 418 denote sampling circuits, 419 denotes a digital-analog converter circuit, 421 denotes a monitor pixel region, 422 denotes a display pixel region, and 423 denotes a video signal line.

Each pixel has the capacitor 403, the light-emitting element 404, the TFT 401, and the TFT 402. In addition, each monitor pixel has the light-emitting element 412 and the TFT 411.

The constant current source 416 is connected to the power supply line 414 and an input of the sampling circuit 417, while the power supply line 414 is connected to one of a source and drain of the TFT 411. The other of the source and drain of the TFT 411 is connected to a gate of the TFT 411, the sampling line 415, and one electrode of the light-emitting element 412. The sampling line 415 is connected to an input of the sampling circuit 418. An output of the sampling circuit 417 is connected to a power source of the digital-analog converter circuit 419 and the power supply line 420. An output of the sampling circuit 418 is connected to the power source of the digital-analog converter circuit 419. The video signal 423 is a digital video signal, and inputted to the digital-analog converter circuit 419. An output of the digital-analog converter circuit 419 is inputted to the source driver 409 as a video signal. An output of the source driver 409 is connected to the source signal line 406. An output of the gate driver 410 is connected to the gate signal line 407. The power supply line 420 is connected to one of a source and drain of the TFT 401. The other of the source and drain of the TFT 401 is connected to one electrode of the light-emitting element 404. A gate of the TFT 401 is connected to one electrode of the capacitor 403 and one of a source and drain of the TFT 402. The other of the source and drain of the TFT 402 is connected to the source signal line 406. A gate of the TFT 402 is connected to the gate signal line 407.

A connecting point between the TFT 401 and one electrode of the light-emitting element 404 is a node Vm 408.

A driving method of FIG. 4 is described.

In the invention, although the display pixel region 422 to be used in displaying images and the monitor pixel region 421 for sampling a potential are separately provided, the invention is not limited to such a structure.

First, an operation of the monitor pixel region 421 is described.

In the monitor pixel region 421, a potential at which an operating point of the TFT 411 and the light-emitting element 412 becomes a boundary between the saturation region and the linear region of the TFT 411 is sampled.

Moreover, the boundary between the saturation region and the linear region is called a pinch-off point. In the case of a P-channel TFT, the following formula is satisfied at the pinch-off point.

Vds=Vgs−Vth (Vds: a voltage between a source and drain, Vgs: a voltage between a source and gate, and Vth: a threshold voltage)

In the saturation region, the following formula is satisfied.

$$Vds<Vgs-Vth$$

In the linear region, the following formula is satisfied.

$$Vds>Vgs-Vth$$

In the monitor pixel region 421, the other of the source and drain of the TFT 411 is connected to the gate of the TFT 411 and one electrode of the light-emitting element 412, and a constant current flows between the source and drain of the TFT 411 and then flows into the light-emitting element 412; therefore, the operating point between the TFT 411 and the light-emitting element 412 is set to be a voltage close to the pinch-off point of the TFT 411. The constant current source 416 is set in a direction in which a current flows from the power supply line 414 to the counter electrode 413, and the TFT 411 is a P-channel TFT; therefore, an electrode of the TFT 411 that is connected to the power supply line 414 is a source, while the other electrode of the TFT 411 that is connected to the light-emitting element 412 is a drain. Since a voltage (drain voltage) between the source and drain of the TFT 411 and a voltage (gate voltage) between the source and gate thereof are equivalent to each other by the connection relation of the aforementioned monitor pixel region 421, in the case of normally on (in the case where a threshold voltage is positive), the TFT 411 operates in the linear region, while in the case of normally off (in the case where the threshold voltage is negative), the TFT 411 operates in the saturation region. That is, the operating point between the TFT 411 and the light-emitting element 412 is extremely close to the pinch-off point or equal to the pinch-off point.

A current value of the constant current source 416 is a value obtained by adding a current value corresponding to the maximum luminance at which the light-emitting element 404 of the display pixel region 422 is expected to emit light, to only the number of the light-emitting elements 412 of the monitor pixel region 421. For example, when the current value corresponding to the maximum luminance at which the light-emitting element 404 of the display pixel region 422 is expected to emit light is set to be Ipix, in the case where the number of the light-emitting elements 412 of the monitor pixel region 421 is n, a current value flowing from the constant current source 416 is n×Ipix.

Next, a sampling method of a potential of the monitor pixel region 421 is described.

A potential of the power supply line 414 and a potential of the sampling line 415 are sampled. The potential of the power supply line 414 becomes a source potential of the TFT 411, while the potential of the sampling line 415 becomes a gate potential and drain potential of the TFT 411. In addition, as described above, the operating point between the TFT 411 and the light-emitting element 412 is extremely close to the pinch-off point of the TFT 411 or equal to the pinch-off point.

The power supply line 414 is connected to the input of the sampling circuit 417. The potential of the power supply line 414 is sampled in the sampling circuit 417, and the sampling circuit 417 outputs a potential corresponding to the sampled potential. Moreover, any configuration may be used for this sampling circuit 417, and the sampling circuit 417 is not limited to a particular configuration. In addition, the sampling circuit 417 is not always required and a configuration without the sampling circuit 417 may be used.

The sampling line 415 is connected to the input of the sampling circuit 418. The potential of the sampling line 415 is sampled in the sampling circuit 418, and the sampling circuit 418 outputs a potential corresponding to the sampled potential. Moreover, any configuration may be used for this sampling circuit 418 and the sampling circuit 418 is not limited to a particular configuration. In addition, the sampling circuit 418 is not always required and a configuration without the sampling circuit 418 may be used.

The outputs of the sampling circuit 417 and the sampling circuit 418 are connected to the power source of the digital-analog converter circuit 419. By using the outputs of the sampling circuit 417 and the sampling circuit 418 for the power source of the digital-analog converter circuit 419, a potential between an output potential of the sampling circuit 417 and an output potential of the sampling circuit 418 can be outputted by the digital-analog converter circuit 419. In addition, the potential outputted by the digital-analog converter circuit 419 is controlled by the video signal 423 connected to an input of the digital-analog converter circuit 419. A general circuit configuration may be used for the digital-analog converter circuit 419. In addition, the digital-analog converter circuit 419 of the invention is not limited to the digital-analog converter circuit shown in this embodiment mode, and any configuration may be used as long as such a circuit is used that an output potential is determined in accordance with the outputs of the sampling circuit 417 and the sampling circuit 418.

Next, operations of the display pixel region 422, the source driver 409, and the gate driver 410 are described.

The output of the sampling circuit 417 is connected to the power supply line 420 to output the potential of the power supply line 414 of the monitor pixel region 421. Here, a configuration of the source driver 409 is not limited, and such a circuit configuration that an output potential of the digital-analog converter circuit 419 is outputted to the source signal line 406 may be used. In addition, a circuit configuration of the gate driver 410 is not limited, and such a configuration that scans the gate signal line 407 may be used.

In the display pixel region 422, a current is supplied from the power supply line 420 to the light-emitting element 404 through the TFT 401. This current is controlled by a voltage (gate voltage) between the gate and source of the TFT 401, and a gate potential of the TFT 401 is supplied from the source signal line 406 through the TFT 402 which is selected by the gate signal line 407 to be turned ON. In addition, since the potential supplied by this source signal line 406 is held in the capacitor 403, the gate potential of the TFT 401 is held for a while even when the TFT 402 selected by the gate signal line 407 to be turned ON becomes OFF.

Here, the potential supplied by the source signal line 406 is a potential having a value between the potential of the power supply line 414 and the potential of the sampling line 415 of the monitor pixel region 421. A potential supplied by the power supply line 420 is the potential of the power supply line 414 of the monitor pixel region 421. In addition, the potential of the power supply line 414 and the potential of the sampling line 415 of the monitor pixel region 421 have a potential relation which allows the light-emitting element 412 to emit light at maximum luminance, and the operating point at maximum luminance is close to the pinch-off point of the TFT 411.

Figure 1:
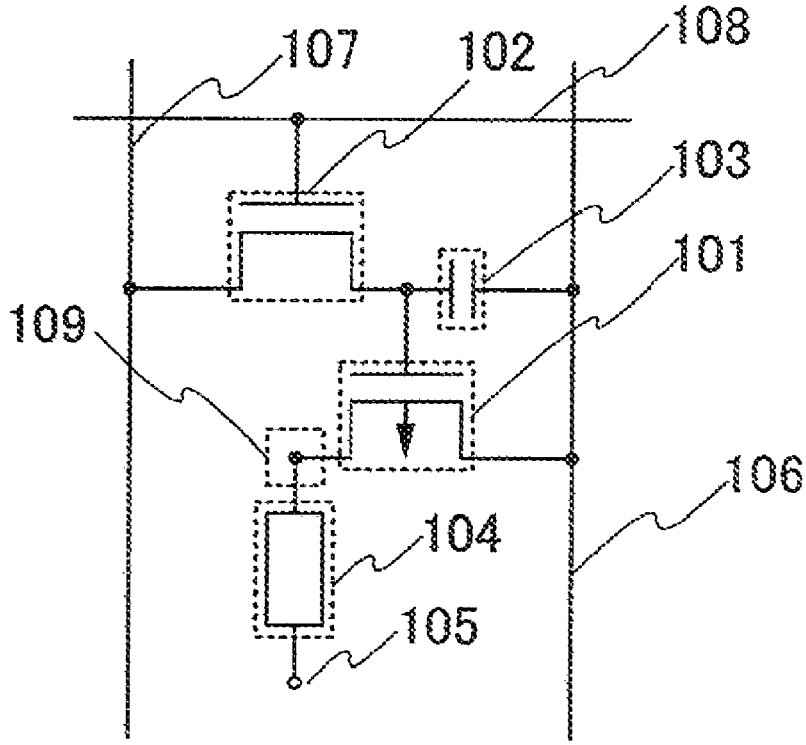
FIG. 1 is a circuit diagram showing a pixel configuration of a conventional EL display device.
Figure 2:
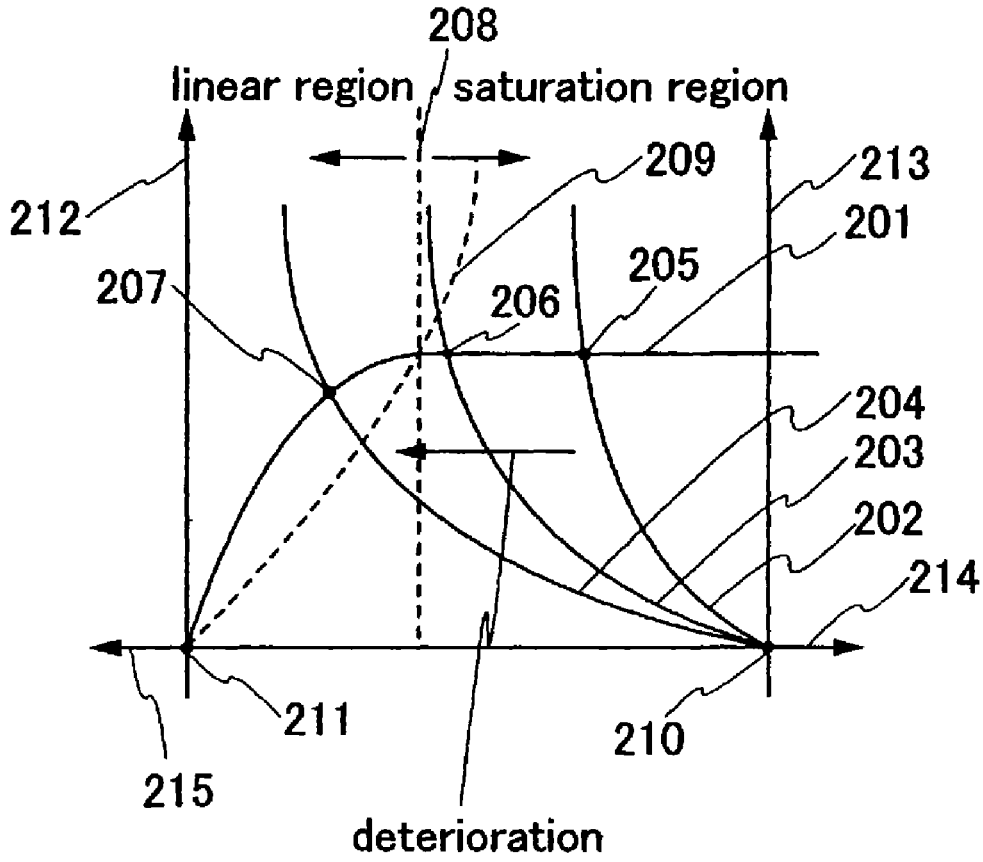
FIG. 2 is a diagram showing a pixel property of the EL display device of FIG. 1.
Figure 3:
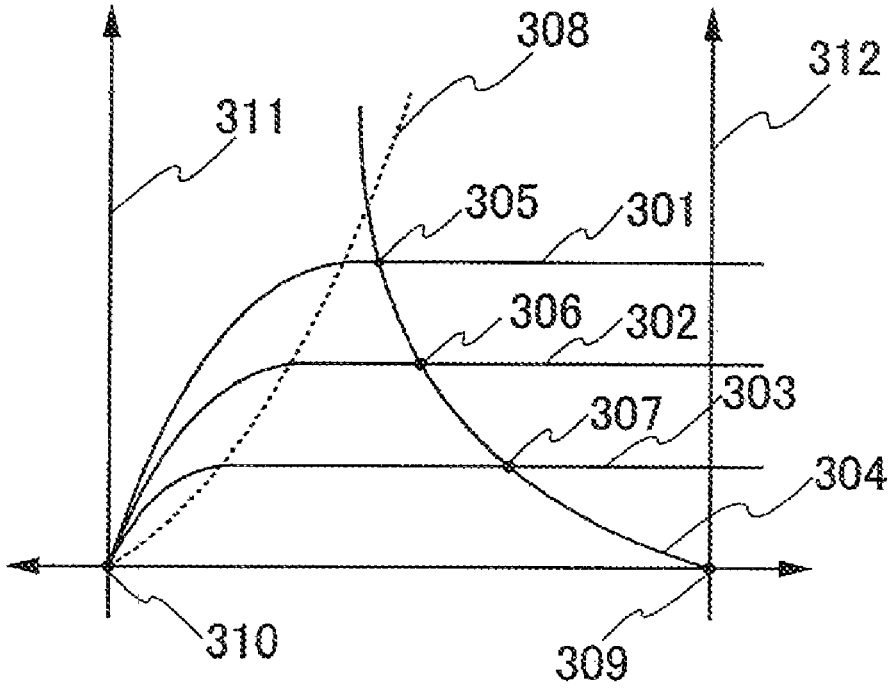
FIG. 3 is a diagram showing a pixel property of the invention.

An operating point between the TFT 401 and the light-emitting element 404 is close to the pinch-off point when a potential of the source signal line 406 is the potential of the sampling line 415, and even when the potential of the source signal line 406 approaches the potential of the power supply line 414, the operating point moves from the pinch-off point to the more saturation region side. This is described with reference to FIG. 3.

Reference numeral 301 denotes a property of the TFT 401, 302 denotes a property of the TFT 401 with increased Vgs, 303 denotes a property of the TFT 401 with further increased Vgs, 304 denotes a property of the light-emitting element 404, 305 denotes an operating point between the TFT 401 with the property 301 and the light-emitting element 404 with the property 304, 306 denotes an operating point between the TFT 401 with the property 302 of increased Vgs and the light-emitting element 404 with the property 304, 307 denotes an operating point between the TFT 401 with the property 303 of further increased Vgs and the light-emitting element 404 with the property 304, 308 denotes a pinch-off curve, 309 denotes a potential of the counter electrode 405, 310 denotes a potential of the power supply line 420, 311 denotes a current flowing between the source and drain of the TFT 401, and 312 denotes a current flowing to the light-emitting element 404.

Potentials at the operating points of 305, 306 and 307 correspond to the potential of the node Vm 408 shown in FIG. 4.

An intersection between the pinch-off curve 308 and the property 301 of the TFT 401, the property 302 of the TFT 401 with increased Vgs, or the property 303 of the TFT 401 with further increased Vgs, correspond to the pinch-off point. When Vgs of the TFT 401 is increased, the operating point moves to the saturation region side further. In this embodiment mode, since a potential relation which can minimize the Vgs is determined in the monitor pixel region 421, the operating point between the TFT 401 and the light-emitting element 404 does not become the linear region.

Moreover, a size (channel width, channel length, or the like) and a property (mobility, threshold voltage, or the like) of the TFT 411 included in the monitor pixel region 421 are desired to be the same or close to a size and the property of the TFT 401 included in the display pixel region 422. In addition, an aperture ratio, a shape or the like of the light-emitting element 412 included in the monitor pixel region 421 is desired to be the same or close to an aperture ratio, and a shape or the like of the light-emitting element 404 included in the display pixel region 422.

In this embodiment mode, as a method to express a luminance gray scale, the output of the digital-analog converter circuit 419 is controlled by the video signal 423 inputted to the digital-analog converter circuit 419. In this manner, the gate voltage of the TFT 401 is adjusted by changing the potential of the source signal line 406. As a result, a current value flowing to the light-emitting element 404 is changed to express the luminance gray scale.

In addition, in this embodiment mode, although P-channel TFTs are used for the TFT 411 and the TFT 401, an N-channel TFT may be used. In the case of using an N-channel TFT for the TFT 411, the gate of the TFT 411 may be connected to one of the source and drain of the TFT 411 (that is, connected to the power supply line 414), and the current from the constant current source 416 may flow in the direction from the counter electrode 413 to the power supply line 414. At this time, a direction of the light-emitting element 412 is also inverted.

Embodiment Mode 2

A display device of Structure 2 is described with reference to FIG. 5.

Figure 5:
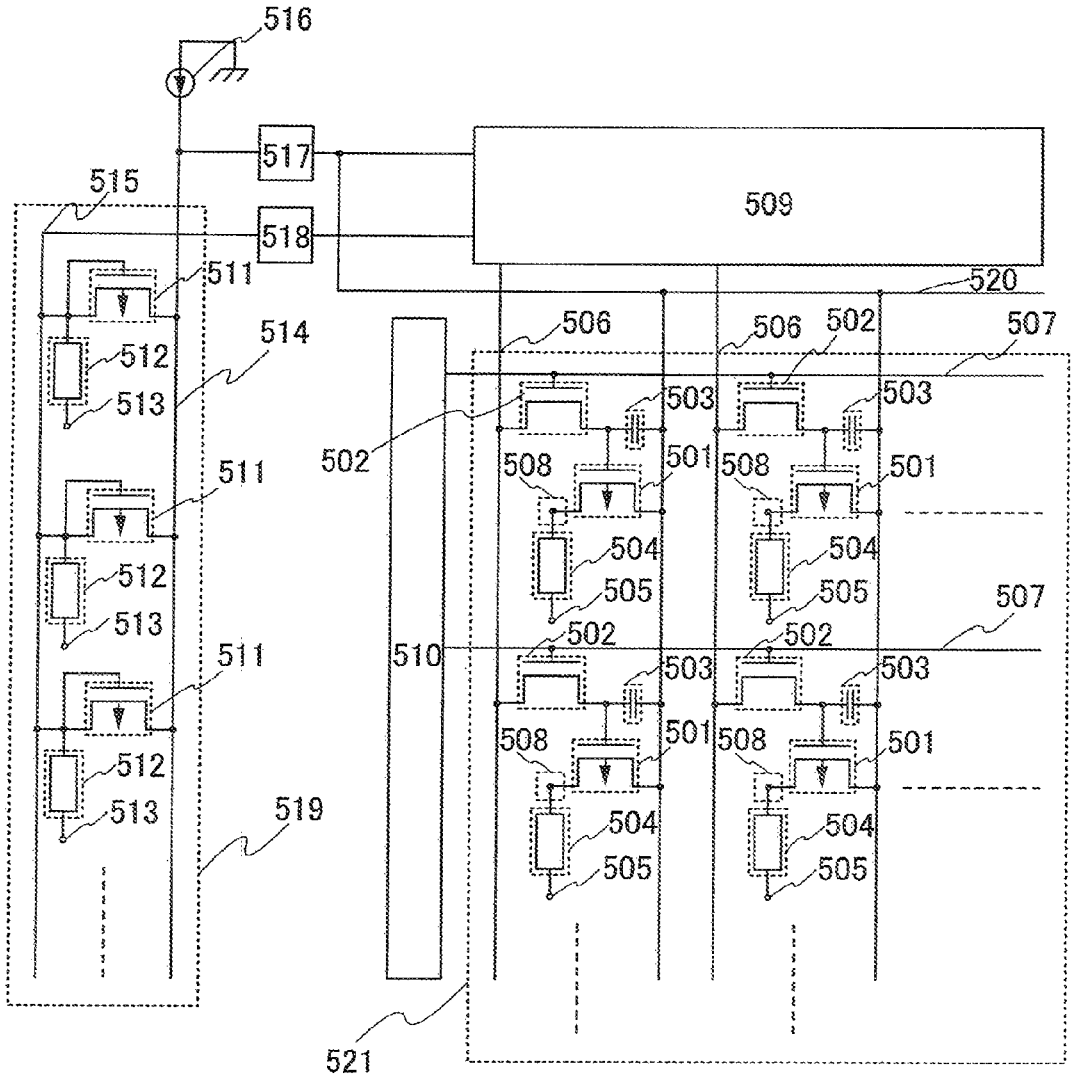
FIG. 5 is a circuit diagram showing a pixel configuration of the invention.

In FIG. 5, reference numerals 501, 502 and 511 denote TFTs, 503 denotes a capacitor, 504 and 512 denote light-emitting elements, 505 and 513 denote counter electrodes, 506 denotes a source signal line, 507 denotes a gate signal line, 509 denotes a source driver, 510 denotes a gate driver, 514 and 520 denote power supply lines, 515 denotes a sampling line, 516 denotes a constant current source, 517 and 518 denote sampling circuits, 519 denotes a monitor pixel region, and 521 denotes a display pixel region.

Each pixel has the capacitor 503, the light-emitting element 504, the TFT 501, and the TFT 502. In addition, each monitor pixel has the light-emitting element 512 and the TFT 511.

The constant current source 516 is connected to the power supply line 514 and an input of the sampling circuit 517. The power supply line 514 is connected to one of a source and drain of the TFT 511. The other of the source and drain of the TFT 511 is connected to a gate of the TFT 511, the sampling line 515, and one electrode of the light-emitting element 512. The sampling line 515 is connected to an input of the sampling circuit 518. An output of the sampling circuit 517 is connected to a power source of a level shifter and a power source of a buffer of the source driver 509. An output of the sampling circuit 518 is connected to the power source of the level shifter and the power source of the buffer of the source driver 509. An output of the source driver 509 is connected to the source signal line 506, while an output of the gate driver 510 is connected to the gate signal line 507. The power supply line 520 is connected to one of a source and drain of the TFT 501. The other of the source and drain of the TFT 501 is connected to one electrode of the light-emitting element 504. A gate of the TFT 501 is connected to one electrode of the capacitor 503 and one of a source and drain of the TFT 502. The other of the source and drain of the TFT 502 is connected to the source signal line 506. A gate of the TFT 502 is connected to the gate signal line 507.

A connecting point between the TFT 501 and one electrode of the light-emitting element 504 is a node Vm 508.

A driving method of FIG. 5 is described.

In the invention, although the display pixel region 521 to be used in displaying images and the monitor pixel region 519 for sampling a potential are separately provided, the invention is not limited to such a structure.

First, an operation of the monitor pixel region 519 is described.

In the monitor pixel region 519, such a voltage at which an operating point of the TFT 511 and the light-emitting element 512 becomes a boundary between the saturation region and the linear region of the TFT 511 is sampled.

Moreover, the boundary between the saturation region and the linear region is called a pinch-off point. In the case of a P-channel TFT, the following formula is satisfied at the pinch-off point.

Vds=Vgs−Vth (Vds: a voltage between a source and drain, Vgs: a voltage between a source and gate, and Vth: a threshold voltage)

In the saturation region, the following formula is satisfied.

$$Vds < Vgs - Vth$$

In the linear region, the following formula is satisfied.

$$Vds > Vgs - Vth$$

In the monitor pixel region 519, the other of the source and drain of the TFT 511 is connected to the gate of the TFT 511 and one electrode of the light-emitting element 512, and a constant current flows between the source and drain of the TFT 511 and then flows into the light-emitting element 512; therefore, the operating point between the TFT 511 and the light-emitting element 512 is set to be a voltage close to the pinch-off point of the TFT 511. The constant current source 516 is set in a direction in which a current flows from the power supply line 514 to the counter electrode 513, and the TFT 511 is a P-channel TFT; therefore, an electrode of the TFT 511 that is connected to the power supply line 514 is a source, while the other electrode of the TFT 511 that is connected to the light-emitting element 512 is a drain. Since a drain voltage and a gate voltage of the TFT 511 are equivalent to each other by the connection relation of the aforementioned monitor pixel region 519, in the case of normally on (in the case where a threshold voltage is positive), the TFT 511 operates in the linear region, while in the case of normally off (in the case where the threshold voltage is negative), the TFT 511 operates in the saturation region. That is, the operating point between the TFT 511 and the light-emitting element 512 is extremely close to the pinch-off point or equal to the pinch-off point.

A current value of the constant current source 516 is a value obtained by adding a current value corresponding to the maximum luminance at which the light-emitting element 504 of the display pixel region 521 is expected to emit light, to only the number of the light-emitting elements 512 of the monitor pixel region 519. For example, when the current value corresponding to the maximum luminance at which the light-emitting element 504 of the display pixel region 521 is expected to emit light is set to be Ipix, in the case where the number of the light-emitting elements 512 of the monitor pixel region 519 is n, a current value flowing from the constant current source 516 is n×Ipix.

Next, a sampling method of a potential of the monitor pixel region 519 is described.

A potential of the power supply line 514 and a potential of the sampling line 515 are sampled. The potential of the power supply line 514 becomes a potential of a source side of the TFT 511, while the potential of the sampling line 515 becomes a drain potential and a gate potential of the TFT 511. In addition, as described above, the operating point between the TFT 511 and the light-emitting element 512 is extremely close to the pinch-off point of the TFT 511 or equal to the pinch-off point.

The power supply line 514 is connected to the input of the sampling circuit 517. The potential of the power supply line 514 is sampled in the sampling circuit 517, and the sampling circuit 517 outputs a potential corresponding to the sampled potential. Moreover, any configuration may be used for this sampling circuit 517 and the sampling circuit 517 is not limited to a particular configuration. In addition, the sampling circuit 517 is not always required and a configuration without the sampling circuit 517 may be used.

The sampling line 515 is connected to the input of the sampling circuit 518. The potential of the sampling line 515 is sampled in the sampling circuit 518, and the sampling circuit 518 outputs a potential corresponding to the sampled potential. Moreover, any configuration may be used for this sampling circuit 518 and the sampling circuit 518 is not limited to a particular configuration. In addition, the sampling circuit 518 is not always required and a configuration without the sampling circuit 518 may be used.

The outputs of the sampling circuit 517 and the sampling circuit 518 are connected to the power source of the level shifter and the power source of the buffer of the source driver 509.

Next, operations of the display pixel region 521, the source driver 509, and the gate driver 510 are described.

The output of the sampling circuit 517 is connected to the power supply line 520 to output the potential of the power supply line 514 of the monitor pixel region 519. Here, a configuration of the source driver 509 is not limited, and such a configuration that output potentials of the sampling circuit 517 and the sampling circuit 518 are outputted to the source signal line 506 may be used. In addition, a configuration of the gate driver 510 is not limited, and such a configuration that scans the gate signal line 507 may be used.

In the display pixel region 521, a current is supplied from the power supply line 520 to the light-emitting element 504 through the TFT 501. This current is controlled by a voltage (gate voltage) between the gate and source of the TFT 501, and a gate potential of the TFT 501 is supplied from the source signal line 506 through the TFT 502 which is selected by the gate signal line 507 to be turned ON. In addition, since the potential supplied by this source signal line 506 is held in the capacitor 503, the gate potential of the TFT 501 is held for a while even when the TFT 502 selected by the gate signal line 507 to be turned ON becomes OFF.

Here, the potential supplied by the source signal line 506 is a potential having a value between the potential of the power supply line 514 and the potential of the sampling line 515 of the monitor pixel region 519. A potential supplied by the power supply line 520 is the potential of the power supply line 514 of the monitor pixel region 519. In addition, the potential of the power supply line 514 and the potential of the sampling line 515 of the monitor pixel region 519 have a potential relation which allows the light-emitting element 512 to emit light at maximum luminance, and the operating point at maximum luminance is close to the pinch-off point of the TFT 511.

An operating point between the TFT 501 and the light-emitting element 504 is close to the pinch-off point when a potential of the source signal line 506 is the potential of the sampling line 515, and even when the potential of the source signal line 506 approaches the potential of the power supply line 514, the operating point moves from the pinch-off point to the more saturation region side by the aforementioned formula (the saturation region is obtained when $Vds<Vgs-Vth$).

Moreover, a size (channel width, channel length, or the like) and a property (mobility, threshold voltage, or the like) of the TFT 511 included in the monitor pixel region 519 are desired to be the same or close to a size and the property of the TFT 501 included in the display pixel region 521. In addition, an aperture ratio, a shape or the like of the light-emitting element 512 included in the monitor pixel region 519 is desired to be the same or close to an aperture ratio, a shape or the like of the light-emitting element 504 included in the display pixel region 521.

In this embodiment mode, as a method to express a luminance gray scale, there is a method (time division gray scale) which controls time when a light-emitting element emits light. In that case, only two values of a signal voltage that is for turning ON the TFT 501 and a signal voltage that is for turning OFF the TFT 501 are outputted from the source driver 509 to the source signal line 506.

In addition, in this embodiment mode, although P-channel TFTs are used for the TFT 511 and the TFT 501, an N-channel TFT may be used. In the case of using an N-channel TFT for the TFT 511, the gate of the TFT 511 may be connected to one of the source and drain of the TFT 511 (that is, connected to the power supply line 514), and the current from the constant current source 516 may flow in the direction from the counter electrode 513 to the power supply line 514. At this time, a direction of the light-emitting element 512 is also inverted.

In Embodiment Mode 1 and Embodiment Mode 2, arrangement of the TFTs is described with reference to FIGS. 4 and 5. However, in the invention, the arrangement of the TFTs is not limited to the arrangement of FIGS. 4 and 5. TFTs can be arranged in an arbitrary position as long as the drive described in Embodiment Mode 1 and Embodiment Mode 2 is possible. For example, a TFT may be added in order to control the light-emitting element to emit no light with a signal which is different from a video signal or a TFT may be added in order to correct a threshold voltage of a driving TFT.

Moreover, in the invention, any circuit configuration may be used for the source drivers, the gate drivers, the sampling circuits, the digital-analog converter circuits, and the like shown in block diagrams as long as the drive described in Embodiment Mode 1 and Embodiment Mode 2 is possible.

In the invention, a known circuit can be used for a driver circuit which inputs a signal to a pixel.

Embodiment 1

An example in which a display device of the invention is actually made is described.

Figure 6A:
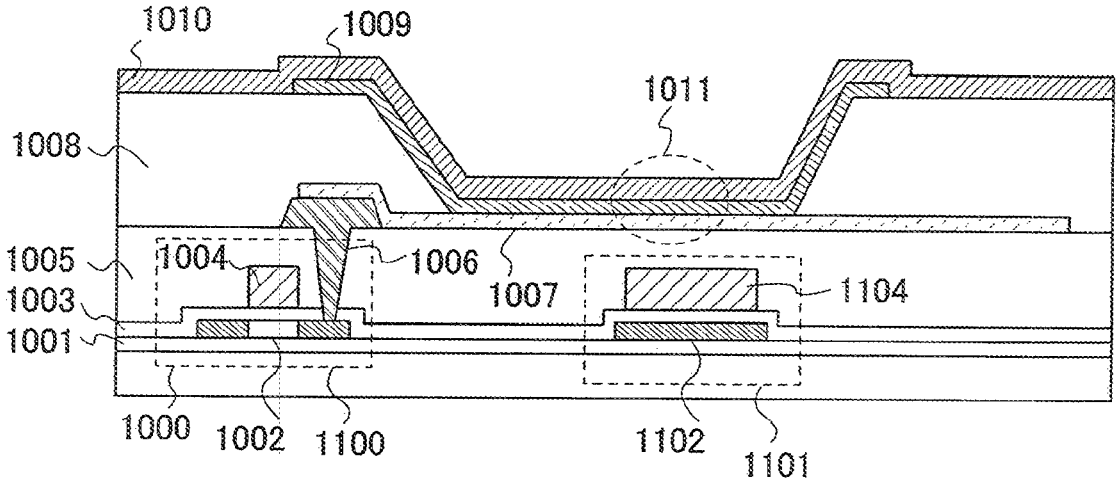
FIGS. 6A and 6B are diagrams each showing Embodiment 1 of the invention.
Figure 6B:
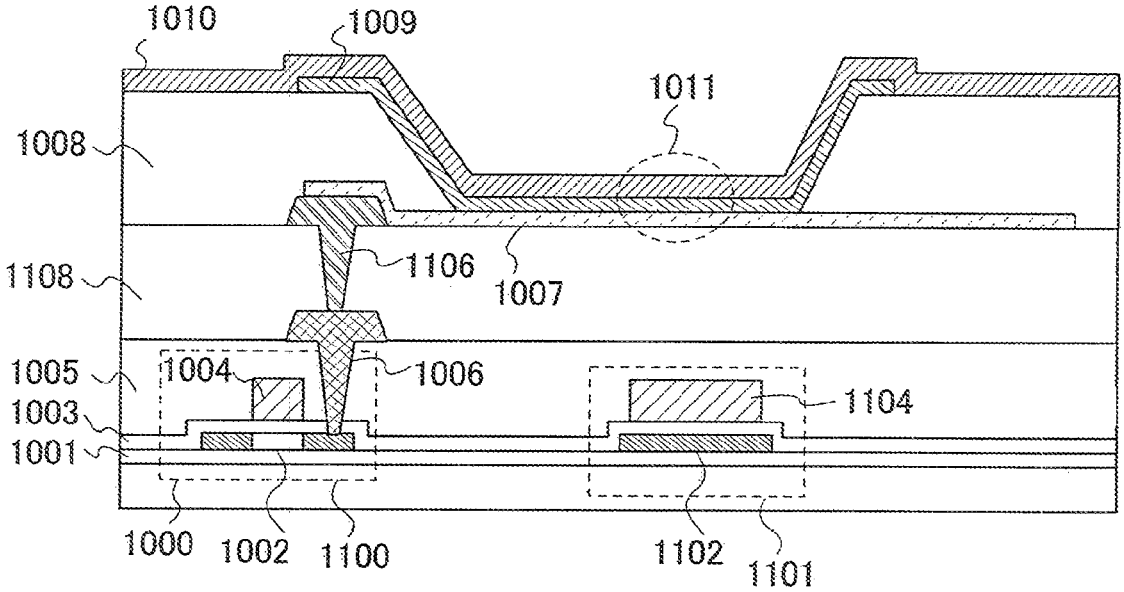

FIGS. 6A and 6B are cross-sectional views of a pixel in a display device of Embodiment Mode 1 and Embodiment Mode 2. An example using a TFT is shown as a transistor arranged in the pixel of Embodiment Mode 1 and Embodiment Mode 2.

In FIGS. 6A and 6B, reference numeral 1000 denotes a substrate, 1001 denotes a base film, 1002 denotes a semiconductor layer, 1102 denotes a semiconductor layer, 1003 denotes a first insulating film, 1004 denotes a gate electrode, 1104 denotes an electrode of a capacitor, 1005 denotes a second insulating film, 1006 denotes a source electrode or drain electrode, 1007 denotes a first electrode, 1008 denotes a third insulating film, 1009 denotes a light-emitting layer, and 1010 denotes a second electrode. In addition, reference numeral 1100 denotes a TFT, 1011 denotes a light-emitting element, and 1101 denotes the capacitor.

In FIGS. 6A and 6B, the TFT 1100, the capacitor 1101, and the light-emitting element 1011 are typically shown as elements forming the pixel. Note that a monitor pixel can have a similar configuration.

A configuration of FIG. 6A is described.

As the substrate 1000, for example, a glass substrate such as barium borosilicate glass or alumino borosilicate glass, a quartz substrate, a ceramic substrate, or the like can be used. Further, a substrate obtained by forming an insulating film over a surface of a metal substrate containing stainless steel or of a semiconductor substrate may be used. A substrate formed of a synthetic resin having flexibility such as plastic may be used as well. A surface of the substrate 1000 may be planarized by a method such as CMP.

As the base film 1001, an insulating film such as silicon oxide, silicon nitride, or silicon nitride oxide can be used. By forming the base film 1001, an alkaline metal such as sodium (Na) or an alkaline earth metal contained in the substrate 1000 can be prevented from diffusing into the semiconductor layer 1002 and affecting adversely on the properties of the TFT 1100. In FIG. 6A, although the base film 1001 has a monolayer structure, a stacked layer structure of two layers or more may be used as well. Note that in the case where impurity diffusion does not become a problem so much such as a quartz substrate, the base film 1001 is not necessarily required to be provided.

As the semiconductor layer 1002 and the semiconductor layer 1102, a crystalline semiconductor film or an amorphous semiconductor film can be used. A crystalline semiconductor film can be obtained by crystallizing an amorphous semiconductor film. As a crystallization method, a laser crystallization method, a thermal crystallization method using RTA or an annealing furnace, a thermal crystallization method using a metal element to promote crystallization, or the like can be used. The semiconductor layer 1002 has a channel forming region and a pair of impurity regions to which an impurity element is added to impart conductivity type. Note that between the channel forming region and the pair of impurity regions, another impurity region to which the impurity element is added at a low concentration may be provided as well. The semiconductor layer 1102 can have a structure in which an impurity element is added entirely to impart conductivity type.

As the first insulating film 1003, silicon oxide, silicon nitride, silicon nitride oxide or the like can be stacked in a monolayer or a plurality of layers.

As the gate electrode 1004 and the electrode 1104 of the capacitor, a monolayer structure or a stacked layer structure formed of one element selected from tantalum (Ta), tungsten (W), titanium (Ti), molybdenum (Mo), aluminum (Al), copper (Cu), chromium (Cr), or neodymium (Nd), or an alloy or a compound containing such elements, can be used.

The TFT 1100 is formed of the semiconductor layer 1002, the gate electrode 1004, and the first insulating film 1003 interposed between the semiconductor layer 1002 and the gate electrode 1004. Although only the TFT 1100 connected to the first electrode 1007 of the light-emitting element 1011 is shown as a TFT forming a pixel in FIG. 6A, a structure having a plurality of TFTs may be used as well. Further, although the TFT 1100 is described as a top-gate transistor in this embodiment, a bottom-gate transistor having a gate electrode below a semiconductor layer may be used, or a dual-gate transistor having gate electrodes above and below a semiconductor layer may be used as well.

The capacitor 1101 is formed of the first insulating film 1003 as a dielectric and the semiconductor layer 1102 and the electrode of the capacitor 1104 as a pair of electrodes which are opposed to each other with the first insulating film 1003 interposed therebetween. Note that as the capacitor 1101 included in the pixel, description is made on an example in which one of the pair of electrodes is the semiconductor layer 1102 formed at the same time as the semiconductor layer 1002 of the TFT 1100 while the other electrode thereof is the electrode of the capacitor 1104 formed at the same time as the gate electrode 1004 of the TFT 1100 in FIG. 6A. However, the structure is not limited to this structure.

As the second insulating film 1005, a monolayer or a stacked layer of an inorganic insulating film or an organic insulating film can be used. As the inorganic insulating film, a silicon oxide film formed by CVD, a silicon oxide film formed by SOG (Spin On Glass), or the like can be used while as the organic insulating film, a film such as polyimide, polyamide, BCB (benzocyclobutene), acrylic, a positive photosensitive organic resin, or a negative photosensitive organic resin can be used.

Further, as the second insulating film 1005, a material composed of a skeleton formed by the bond of silicon (Si) and oxygen (O) can be used. An organic group containing at least hydrogen (such as an alkyl group or aromatic hydrocarbon) is used as a substituent of this material. Alternatively, a fluoro group may be used as the substituent. Further alternatively, both a fluoro group and an organic group containing at least hydrogen may be used as the substituent.

As the source electrode or drain electrode 1006, a monolayer structure or a stacked layer structure formed of one element selected from aluminum (Al), nickel (Ni), carbon (C), tungsten (W), molybdenum (Mo), titanium (Ti), platinum (Pt), copper (Cu), tantalum (Ta), gold (Au), or manganese (Mn), or an alloy or a compound containing such elements can be used.

One or both of the first electrode 1007 and the second electrode 1010 may be a light-transmissive electrode. As the light-transmissive electrode, indium tin oxide (ITO), zinc oxide (ZnO), zinc oxide doped with gallium (GZO), or other light-transmissive conductive oxide materials can be used. In addition, ITO containing silicon oxide (hereinafter referred to as ITSO), ITO containing titanium oxide (hereinafter referred to as ITTO), ITO containing molybdenum oxide (hereinafter referred to as ITMO), ITO doped with titanium, molybdenum, or gallium, or a material formed by mixing indium oxide containing silicon oxide with zinc oxide (ZnO) as a target by 2 to 20 wt % may be used as well.

The other of the first electrode 1007 and the second electrode 1010 may be formed of a material having no light-transmitting property. For example, an alkaline metal such as lithium (Li) or cesium (Cs), an alkaline earth metal such as magnesium (Mg), calcium (Ca), or strontium (Sr), an alloy including these (Mg:Ag, Al:Li, Mg:In or the like), a compound of these (calcium fluoride, calcium nitride), or a rare earth metal such as ytterbium (Yb) or erbium (Er) can be used.

A material similar to that of the second insulating film 1005 can be used to form the third insulating film 1008. The third insulating film 1008 is formed on the periphery of the first electrode 1007 so as to cover an end portion of the first electrode 1007, and has a function to separate the light-emitting layer 1009 in adjacent pixels.

The light-emitting layer 1009 is formed of a monolayer or a plurality of layers. In the case of forming of a plurality of layers, these layers are classified, in view of carrier transport properties, into a hole injecting layer, a hole transporting layer, a light-emitting layer, an electron transporting layer, an electron injecting layer, or the like. Note that boundaries of each layer are not required to be clear, and there are some cases where materials forming respective layers are partially mixed; therefore, interfaces are not defined clearly. An organic material or an inorganic material can be used for each layer. As the organic material, any of a polymeric material, a middle molecular weight material, and a low molecular weight material can be used.

The light-emitting element 1011 includes the first electrode 1007, the second electrode 1010, and the light-emitting layer 1009 between the first and second electrodes. One of the first electrode 1007 and the second electrode 1010 corresponds to an anode, and the other thereof corresponds to a cathode. When a voltage higher than a threshold voltage is applied between the anode and the cathode in forward bias direction, a current flows from the anode to the cathode, therefore, the light-emitting element 1011 emits light.

Description is made on a structure of FIG. 6B. Note that the same reference numerals are used for the same portions as FIG. 6A, and description thereof is omitted.

FIG. 6B is a structure including a fourth insulating film 1108 between the second insulating film 1005 and the third insulating film 1008 in FIG. 6A.

Moreover, the source electrode or drain electrode 1006 and the first electrode 1007 are connected through a connection electrode 1106 in a contact hole provided in the insulating film 1108.

The fourth insulating film 1108 can have a similar structure to the second insulating film 1005. The connection electrode 1106 can have a similar structure to the source electrode or drain electrode 1006.

This embodiment can be implemented by freely combining with embodiment modes.

Embodiment 2

Figure 7A:
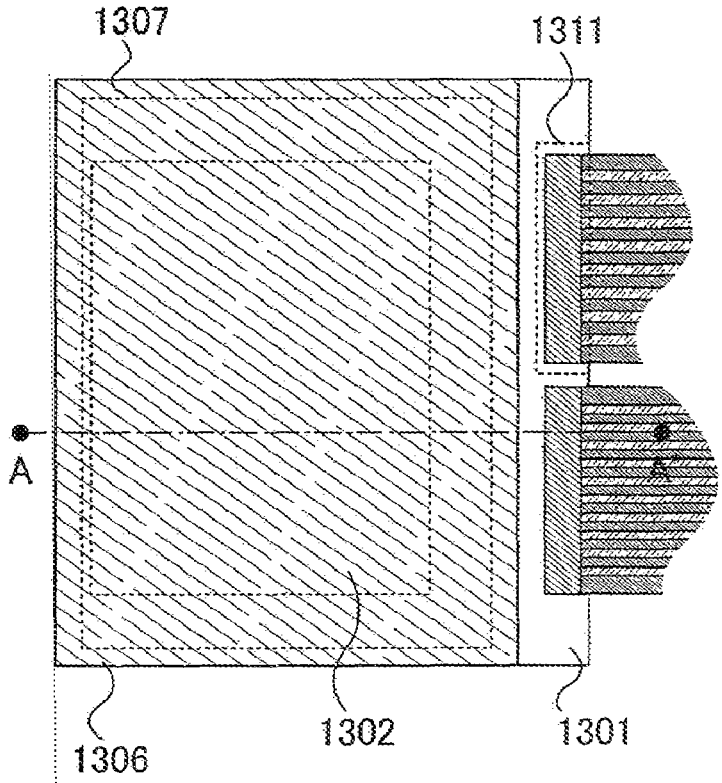
FIGS. 7A to 7C are diagrams each showing Embodiment 2 of the invention.
Figure 7B:
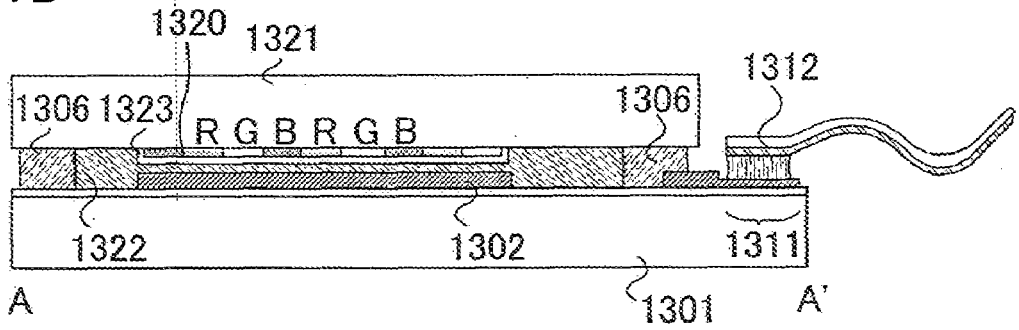
Figure 7C:
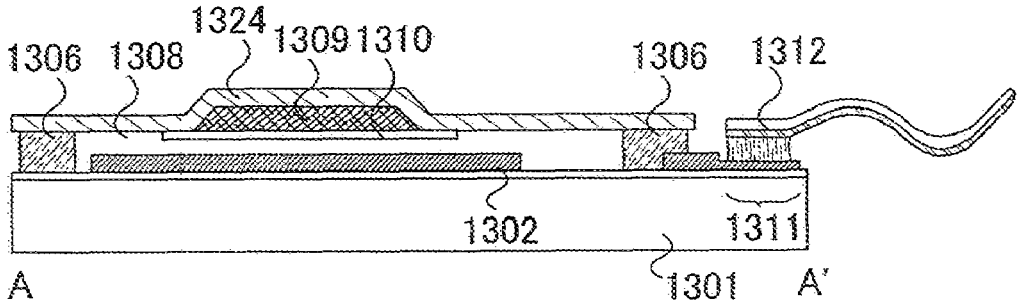

In this embodiment, description is made on a structure for sealing a display device with reference to FIGS. 7A to 7C. FIG. 7A is a top plan view of a display panel formed by sealing a display device, and each of FIGS. 7B and 7C is a cross sectional view along a line A-A' of FIG. 7A. Note that FIGS. 7B and 7C are examples for performing sealing by different methods.

In FIGS. 7A to 7C, a display portion 1302 having a plurality of pixels is arranged over a substrate 1301, and to surround them, a sealing material 1306 is provided to stick a sealing material 1307. As for a pixel configuration, structures of embodiment modes or Embodiment 1 can be used.

In a display panel in FIG. 7B, the sealing material 1307 in FIG. 7A corresponds to a counter substrate 1321. The sealing material 1306 is used as an adhesive layer and a light-transmissive counter substrate 1321 is stuck thereto. The substrate 1301, the counter substrate 1321, and the sealing material 1306 form a closed space 1322. A color filter 1320 and a protective film 1323 to protect the color filter are provided to the counter substrate 1321. Light emitted from a light-emitting element arranged in the display portion 1302 is emitted outside through the color filter 1320. The closed space 1322 is filled with an inert resin, a liquid, or the like. Note that as the resin to fill the closed space 1322, a light-transmissive resin in which a moisture absorption material is dispersed may be used as well. Further, the sealing material 1306 and a material for filling the closed space 1322 may be the same material, and adhesion of the counter substrate 1321 and sealing of the display portion 1302 may be performed at the same time.

In a display panel shown in FIG. 7C, the sealing material 1307 in FIG. 7A corresponds to a sealing material 1324. The sealing material 1306 is used as an adhesive layer and the sealing material 1324 is stuck thereto. The substrate 1301, the sealing material 1306, and the sealing material 1324 form a closed space 1308. An absorbent 1309 is provided in a depressed portion of the sealing material 1324 in advance, and inside the closed space 1308, the absorbent 1309 absorbs moisture, oxygen, or the like to keep a clean atmosphere and functions to suppress deterioration of the light-emitting element. This depressed portion is covered with a cover material 1310 with a fine mesh. Although air and moisture are passed through the cover material 1310, they are not passed though the absorbent 1309. Note that the closed space 1308 may be filled with a rare gas such as nitrogen or argon, and can be filled with a resin or a liquid as long as it is inert.

Over the substrate 1301, provided is an input terminal portion 1311 for transmitting a signal to the display portion 1302 and the like, and transmitted is a signal such as a video signal to the input terminal portion 1311 through an FPC (Flexible Printed Circuit) 1312. In the input terminal portion 1311, a wiring formed over the substrate 1301 is electrically connected to a wiring provided over the FPC 1312 by using a resin (anisotropic conductive resin: ACF) in which a conductor is dispersed.

Over the substrate 1301 over which the display portion 1302 is formed, a driver circuit to input a signal to the display portion 1302 may be integrally formed. A driver circuit to input a signal to the display portion 1302 may be formed with an IC chip and connected onto the substrate 1301 by COG (Chip On Glass), or an IC chip may be arranged over the substrate 1301 by using TAB (Tape Auto Bonding) or a printed board.

This embodiment can be implemented by freely combining with embodiment modes and Embodiment 1.

Embodiment 3

The invention can be applied to a display module in which a circuit to input a signal to a display panel is mounted onto a display panel.

Figure 8:
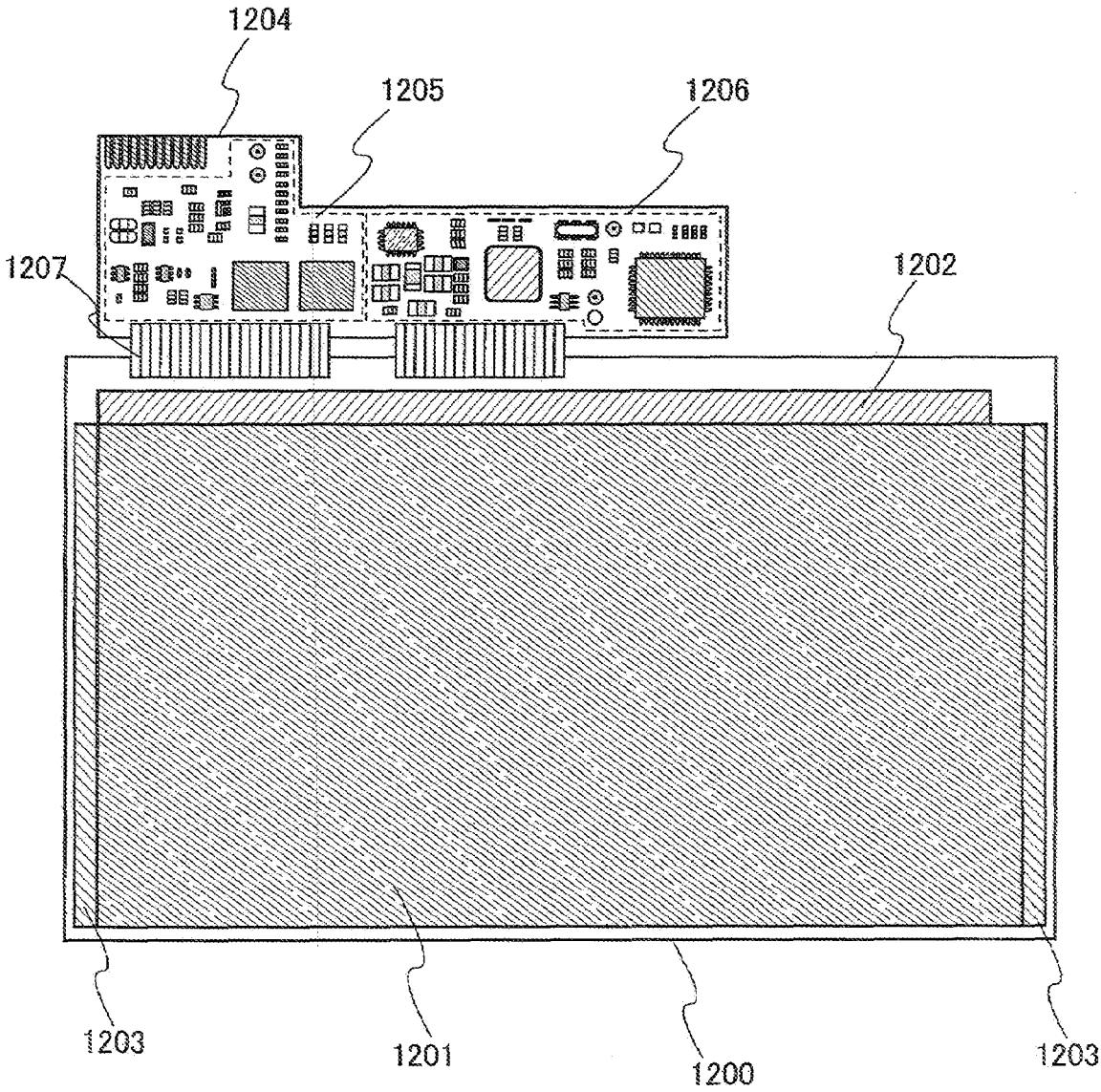
FIG. 8 is a diagram showing Embodiment 3 of the invention.

FIG. 8 shows a display module in which a display panel 1200 and a circuit board 1204 are combined.

In FIG. 8, shown is an example in which a control circuit 1205, a signal division circuit 1206, and the like are formed over the circuit board 1204. A circuit formed over the circuit board 1204 is not limited to this. Any circuit which generates a signal to control a display panel may be formed as well.

Signals outputted from these circuits formed over the circuit board 1204 are inputted to the display panel 1200 through a connection wiring 1207.

The display panel 1200 has a display portion 1201, a source driver 1202, and a gate driver 1203. A structure of the display panel 1200 can have a similar structure to a structure described in Embodiment 2 or the like. FIG. 8 shows an example in which the source driver 1202 and the gate driver 1203 are formed over the same substrate as the display portion 1201. However, the display module of the invention is not limited to this. Only the gate driver 1203 may be formed over the same substrate as the display portion 1201, and a source driver may be formed over a circuit board. Both a source driver and a gate driver may be formed over a circuit board as well.

Display portions of various electronic apparatuses can be formed with such display modules incorporated therein.

This embodiment can be implemented by freely combining with embodiment modes, and Embodiments 1 and 2.

Embodiment 4

As an electronic apparatus using the display module of the invention, there are a camera such as a video camera and a digital still camera, a goggle type display (a head mounted display), a navigation system, an audio reproducing device (a car audio, an audio component and the like), a personal computer, a game machine, a portable information terminal (a mobile computer, a mobile phone, a portable game machine, an electronic book, or the like), an image reproducing device provided with a recording medium reading portion (specifically, a device which reproduces a recording medium such as a Digital Versatile Disc (DVD), and is provided with a display capable of displaying the reproduced image), and the like. In particular, for a portable information terminal of which a display is often looked from an oblique direction, the range of a viewing angle is emphasized; therefore, it is desired to use a self-luminous display device. The invention is particularly effective on a portable information apparatus in which reduction of power consumption is an essential task.

Specific examples of electronic apparatuses are described in FIGS. 9A to 9H. Note that electronic apparatuses described here are just illustrative, and the invention is not limited to these applications.

Figure 9A:
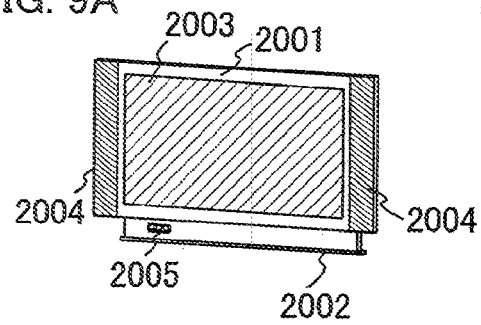
FIGS. 9A to 9H are views each showing an example of an electronic apparatus of the invention.

FIG. 9A shows a display including a housing 2001, a support base 2002, a display portion 2003, speaker portions 2004, a video input terminal 2005, and the like. The display module of the invention can be used for the display portion 2003. Note that the display includes all display devices for displaying information such as a display device for a personal computer, for TV broadcast reception, and for advertisement display.

Figure 9B:
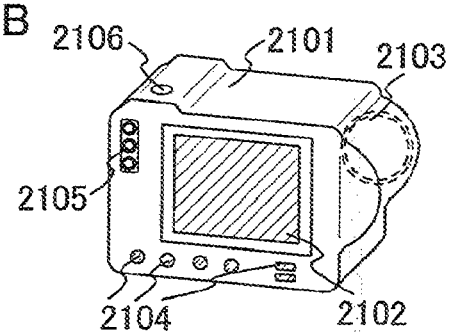

FIG. 9B shows a digital still camera including a main body 2101, a display portion 2102, an image receiving portion 2103, operation keys 2104, an external connection port 2105, a shutter 2106, and the like. The display module of the invention can be used for the display portion 2102.

Figure 9C:
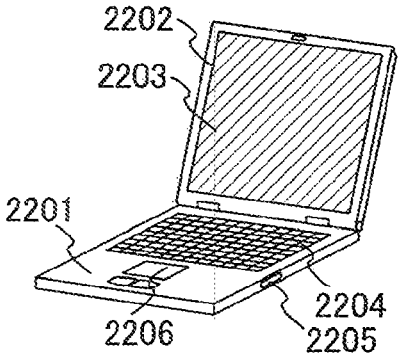

FIG. 9C shows a personal computer including a main body 2201, a housing 2202, a display portion 2203, a keyboard 2204, an external connection port 2205, a pointing pad 2206, and the like. The display module of the invention can be used for the display portion 2203.

Figure 9D:
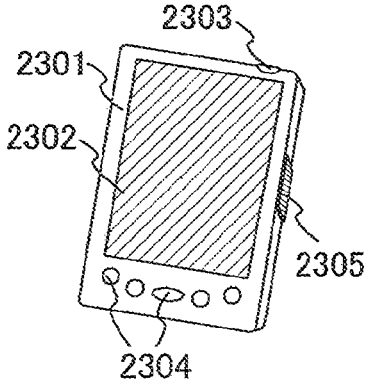

FIG. 9D shows a mobile computer including a main body 2301, a display portion 2302, a switch 2303, operation keys 2304, an infrared port 2305, and the like. The display module of the invention can be used for the display portion 2302.

Figure 9E:
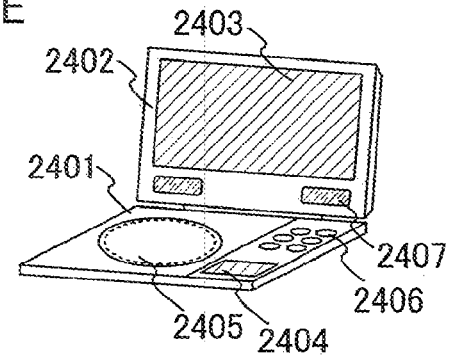

FIG. 9E shows a portable image reproducing device (specifically, a DVD reproducing device) provided with a recording medium reading portion, including a main body 2401, a housing 2402, a display portion A 2403, a display portion B 2404, a recording medium (DVD and the like) reading portion 2405, an operation key 2406, a speaker portion 2407, and the like. The display portion A 2403 mainly displays image data while the display portion B 2404 mainly displays text data. However, the display module of the invention can be used for the display portion A 2403 and the display portion B 2404. Note that an image reproducing device provided with a recording medium includes a game machine and the like.

Figure 9F:
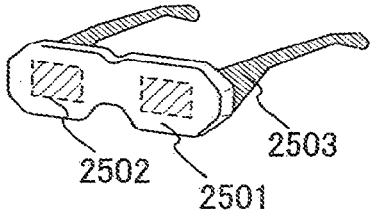

FIG. 9F shows a goggle type display (a head mounted display) including a main body 2501, a display portion 2502, an arm portion 2503, and the like. The display module of the invention can be used for the display portion 2502.

Figure 9G:
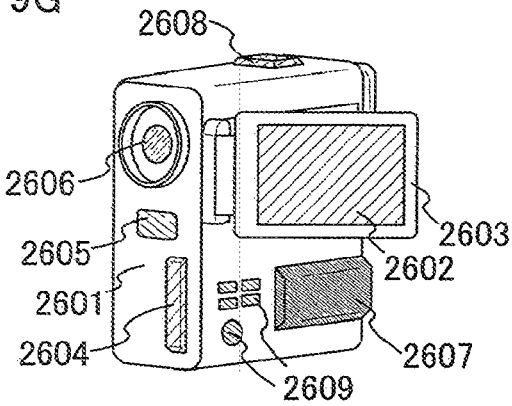

FIG. 9G shows a video camera including a main body 2601, a display portion 2602, a housing 2603, an external connection port 2604, a remote control receiving portion 2605, an image receiving portion 2606, a battery 2607, a sound input portion 2608, operation keys 2609, and the like. The display module of the invention can be used for the display portion 2602.

Figure 9H:
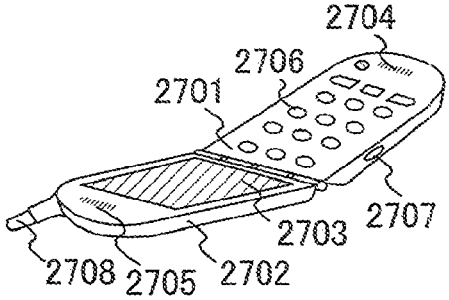

Here, FIG. 9H shows a mobile phone including a main body 2701, a housing 2702, a display portion 2703, a sound input portion 2704, a sound output portion 2705, an operation key 2706, an external connection port 2707, an antenna 2708, and the like. The display module of the invention can be used for the display portion 2703. Note that the display portion 2703 displays white text on a black background; therefore, the power consumption of the mobile phone can be suppressed further.

Note that when the light emission luminance of a light-emitting element increases in the future, outputted light including image data can be enlarged and projected by a lens or the like to be used for a front projector or a rear projector.

Further, the aforementioned electronic apparatuses display data distributed through a telecommunication line such as the Internet or a CATV (cable television) in many cases, and particularly, an opportunity to display video data has been increasing. The response speed of a light-emitting material is extremely high; therefore, the display module of the invention is preferable for displaying video data.

Moreover, the display device of the invention consumes electricity in a light-emitting portion; therefore, it is desirable to display data so as to minimize the light-emitting portion. Accordingly, in the case of using the display module for a display portion which mainly displays text data such as a portable information terminal, particularly a mobile phone or an audio reproducing device, it is desirable to drive so as to form text data with a light-emitting portion while a non-light-emitting portion is used as a background.

As set forth above, the applicable range of the invention is extremely wide; therefore, the invention can be used for electronic apparatuses of various fields.

This embodiment can be implemented by freely combining with embodiment modes and Embodiments 1 to 3.

This application is based on Japanese Patent Application serial no. 2005-101152 filed in Japan Patent Office on Mar. 31, in 2005, the entire contents of which are hereby incorporated by reference.

What is claimed is:

1. A display device comprising:

a current source;

a monitor pixel region comprising:

a first wiring;

a second wiring;

a first light-emitting element; and a first transistor;

a display portion including a pixel, a source driver, and a gate driver, the pixel comprising:

a second transistor; and a second light-emitting element electrically connected to one of a source and a drain of the second transistor; and a first sampling circuit electrically connected to the first wiring and the other of the source and the drain or the second transistor, wherein one of a source and a drain of the first transistor is electrically connected to the current source through the first wiring, wherein the other of the source and the drain of the first transistor is connected to a gate of the first transistor, and wherein the other of the source and the drain of the first transistor and the gate of the first transistor are electrically connected to the second wiring and one electrode of the first light-emitting element.

2. The display device according to claim 1, wherein the first transistor is a normally off transistor.

3. The display device according to claim 1, wherein the display device is incorporated into an electronic apparatus selected from the group consisting of a video camera, a digital still camera, a goggle type display, a navigation system, an audio reproducing device, a personal computer, a game machine, a mobile computer, a mobile phone, a portable game machine, an electronic book, and an image.

4. The display device according to claim 1, wherein the display device further comprising:

a second sampling circuit electrically connected to the second wiring.

5. The display device according to claim 1, wherein the display device further comprises a digital-analog converter circuit electrically connected to the first and second wiring.

6. The display device according to claim 1, wherein the other of the source and the drain of the first transistor is connected directly to the gate of the first transistor without any intervening elements.

7. A display device comprising:

a current source;

a monitor pixel region comprising:

a first wiring;

a second wiring;

a first light-emitting element; and a first transistor:

a display portion including a pixel, a source driver, and a gate driver, the pixel comprising:

a third wiring:

a second transistor; and a second light-emitting element electrically connected to one of a source and a drain of the second transistor;

a first sampling circuit electrically connected to the first wiring and the other of the source and the drain of the second transistor through the third wiring;

a second sampling circuit; and a digital-analog converter circuit, wherein one of a source and a drain of the first transistor is electrically connected to the current source through the first wiring, the other of the source and the drain of the first transistor is connected to a gate of the first transistor, and the other of the source and drain of the first transistor and the gate of the first transistor are electrically connected to the second wiring and one electrode of the first light-emitting element, wherein the first sampling circuit configured to hold a first potential of the first wiring for a certain period and supply a second potential to the third wiring, wherein the second sampling circuit is configured to hold a third potential of the second wiring for a certain period;

wherein the digital-analog converter circuit is configured to determine a minimum output potential and a maximum output potential by the first potential held in the first sampling circuit and the third potential held in the second sampling circuit, and wherein the source driver is configured to supply a signal in accordance with an output of the digital-analog converter circuit to a gate of the second transistor.

8. The display device according to claim 7, wherein a fourth potential of the signal is smaller than the first potential of the first wiring.

9. The display device according to claim 7, wherein the first transistor and the second transistor are P-channel transistors.

10. The display device according to claim 7, wherein a channel width and a channel length of the first transistor are the same as a channel width and a channel length of the second transistor.

11. The display device according to claim 7, wherein the first transistor and the second transistor are formed over the same substrate as the second light-emitting element.

12. The display device according to claim 7, wherein an operating point of the first transistor and the first light-emitting element and an operating point of the second transistor and the second light-emitting element are a saturation region of the first transistor and a saturation region of the second transistor respectively.

13. The display device according to claim 7, wherein a structure of first light-emitting element is the same as a structure of the second light-emitting element.

14. The display device according to claim 7, wherein the first transistor is a normally off transistor.

15. The display device according to claim 7, wherein the display device is incorporated into an electronic apparatus selected from the group consisting of a video camera, a digital still camera, a goggle type display, a navigation system, an audio reproducing device, a personal computer, a game machine, a mobile computer, a mobile phone, a portable game machine, an electronic book, and an image reproducing device.

16. The display device according to claim 7, wherein the other of the source and the drain of the first transistor is connected directly to the gate of the first transistor without any intervening elements.

17. A display device comprising:

a current source a monitor pixel region comprising:

a first wiring;

a second wiring;

a first light-emitting element; and a first transistor;

a display portion including a pixel, a source driver, and a gate driver, the pixel comprising:

a third wiring;

a fourth wiring;

a fifth wiring;

a second transistor;

a third transistor; and a second light-emitting element electrically connected to one of a source and a drain of the second transistor;

a first sampling circuit electrically connected to the first wiring and the other of the source and the drain of the second transistor through the third wiring;

a second sampling circuit; and a digital-analog converter circuit;

wherein one of a source and a drain of the first transistor is electrically connected to the current source through the first wiring, the other of the source and the drain of the first transistor is connected to a gate of the first transistor, and the other of the source and drain of the first transistor and a gate of the first transistor are electrically connected to the second wiring and one electrode of the first light-emitting element, wherein one of a source and a drain of the third transistor is electrically connected to the fourth wiring, and the other of the source and the drain of the third transistor is electrically connected to a gate of the second transistor, and a gate of the third transistor is electrically connected to the fifth wiring, wherein the first sampling circuit is configured to hold a first potential of the first wiring for a certain period and supply a second potential to the third wiring, wherein a second sampling circuit configured to hold a potential of the second wiring for a certain period, wherein the digital-analog converter circuit is configured to determine a minimum output potential and a maximum output potential by the first potential held in the first sampling circuit and a third potential held in the second sampling circuit, wherein the source driver is configured to supply a signal in accordance with an output of the digital-analog converter circuit to the fourth wiring, and wherein the gate driver is configured to supply a selection signal to the fifth wiring.

18. The display device according to claim 17, wherein a fourth potential of the signal is smaller than the first potential of the first wiring.

19. The display device according to claim 17, wherein the first transistor and the second transistor are P-channel transistors.

20. The display device according to claim 17, wherein a channel width and a channel length of the first transistor are the same as a channel width and a channel length of the second transistor.

21. The display device according to claim 17, wherein the first transistor and the second transistor are formed over the same substrate as the second light-emitting element.

22. The display device according to claim 17, wherein an operating point of the first transistor and the first light-emitting element and an operating point of the second transistor and the second light-emitting element are a saturation region of the first transistor and a saturation region of the second transistor respectively.

23. The display device according to claim 17, wherein a structure of first light-emitting element is the same as a structure of the second light-emitting element.

24. The display device according to claim 17, wherein the first transistor is a normally off transistor.

25. The display device according to claim 17, wherein the display device is incorporated into an electronic apparatus selected from the group consisting of a video camera, a digital still camera, a goggle type display, a navigation system, an audio reproducing device, a personal computer, a game machine, a mobile computer, a mobile phone, a portable game machine, an electronic book, and an image reproducing device.

26. The display device according to claim 17, wherein the other of the source and the drain of the first transistor is connected directly to the gate of the first transistor without any intervening elements.

27. A display device comprising:

a current source:

a monitor pixel region comprising:

a first wiring;

a second wiring;

a first light-emitting element; and a first transistor;

a display portion including a pixel, a source driver, and a gate driver, the pixel comprising:

a third wiring;

a second transistor; and a second light-emitting element electrically connected to one of a source and a drain of the second transistor;

a first sampling circuit electrically connected to the first wiring and the other of the source and the drain of the second transistor through the third wiring;

a second sampling circuit electrically connected to the second wiring; and a digital-analog converter circuit electrically connected to the first and second sampling circuits, and wherein one of a source and a drain of the first transistor is electrically connected to the current source through the first wiring, the other of the source and the drain of the first transistor is connected to a gate of the first transistor, and the other of the source and the drain of the first transistor and the gate of the first transistor are electrically connected to the second wiring and one electrode of the first light-emitting element.

28. The display device according to claim 27, wherein the first transistor and the second transistor are P-channel transistors.

29. The display device according to claim 27, wherein a channel width and a channel length of the first transistor are the same as a channel width and a channel length of the second transistor.

30. The display device according to claim 27, wherein the first transistor and the second transistor are formed over the same substrate as the second light-emitting element.

31. The display device according to claim 27, wherein a structure of first light-emitting element is the same as a structure of the second light-emitting element.

32. The display device according to claim 27, wherein the first transistor is a normally off transistor.

33. The display device according to claim 27, wherein the display device is incorporated into an electronic apparatus selected from the group consisting of a video camera, a digital still camera, a goggle type display, a navigation system, an audio reproducing device, a personal computer, a game machine, a mobile computer, a mobile phone, a portable game machine, an electronic book, and an image reproducing device.

34. The display device according to claim 27, wherein the other of the source and the drain of the first transistor is connected directly to the gate of the first transistor without any intervening elements.

* * * * *

UNITED STATES PATENT AND TRADEMARK OFFICE

CERTIFICATE OF CORRECTION

PATENT NO. : 7,714,816 B2
APPLICATION NO. : 11/277883
DATED : May 11, 2010
INVENTOR(S) : Atsushi Umezaki It is certified that error appears in the above-identified patent and that said Letters Patent is hereby corrected as shown below:

Column 23, line 11, in claim 5 replace "wiring" with --wirings--.

Signed and Sealed this

Fourteenth Day of September, 2010

David J. Kappos

David J. Kappos
*Director of the United States Patent and Trademark Office*